US007933530B2

(12) United States Patent
Cook et al.

(10) Patent No.: US 7,933,530 B2
(45) Date of Patent: Apr. 26, 2011

(54) FUSER ASSEMBLY FAN CONTROL

(75) Inventors: William Paul Cook, Lexington, KY (US); Hrishikesh Pramod Gogate, Lexington, KY (US); Kimberely Aubrey Thuringer, Lexington, KY (US); Edward Lynn Triplett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 463 days.

(21) Appl. No.: 12/055,754

(22) Filed: Mar. 26, 2008

(65) Prior Publication Data

US 2009/0245839 A1 Oct. 1, 2009

(51) Int. Cl.
*G03G 15/20* (2006.01)
*G03G 21/20* (2006.01)

(52) U.S. Cl. ..... 399/69; 399/92

(58) Field of Classification Search ..... 399/69, 399/92

See application file for complete search history.

(56) References Cited

U.S. PATENT DOCUMENTS

| | | | | |
|---|---|---|---|---|
| 2005/0105929 | A1* | 5/2005 | Chae et al. | 399/69 |
| 2006/0127119 | A1* | 6/2006 | Sato | 399/69 |
| 2007/0059001 | A1* | 3/2007 | Matsuura et al. | 399/45 |
| 2007/0059022 | A1* | 3/2007 | Yamaoka et al. | 399/92 |
| 2007/0196119 | A1* | 8/2007 | Fujita | 399/68 |

OTHER PUBLICATIONS

Machine translation of reference Oka et al. (JP 2003-330,298) pub date Nov. 19, 2003.*
U.S. Appl. No. 11/948,077, filed Nov. 30, 2007, Cao et al.
U.S. Appl. No. 12/055,614, Cook et al., filed concurrently herewith.
U.S. Appl. No. 12/055,399, Gogate et al., filed concurrently herewith.
U.S. Appl. No. 12/055,561, Cook et al., filed concurrently herewith.

* cited by examiner

*Primary Examiner* — David M Gray
*Assistant Examiner* — Rodney Bonnette

(57) ABSTRACT

A printer is provided including a reference edge, a fuser assembly, a cooling apparatus and a controller. The reference edge is adapted to be contacted by a substrate as the substrate moves along a substrate path through the printer. The fuser assembly includes a heat transfer member including a belt and a backup member. The cooling apparatus is adapted to move cooling air capable of cooling the fuser assembly. The controller is configured to activate the cooling apparatus after determining that a first end portion of the backup member opposite a second end portion of the backup member near the reference edge is at a temperature above a predefined first threshold temperature.

14 Claims, 4 Drawing Sheets

FUSER ASSEMBLY FAN CONTROL

This application is related to U.S. patent application Ser. No. 12/055,614, entitled FUSER HEATER TEMPERATURE CONTROL; U.S. patent application Ser. No. 12/055,399, entitled PRINTER INCLUDING A FUSER ASSEMBLY WITH BACKUP MEMBER TEMPERATURE SENSOR; and U.S. patent application Ser. No. 12/055,561, entitled FUSER ASSEMBLY HEATER TEMPERATURE CONTROL, all of which are hereby incorporated by reference herein.

FIELD OF THE INVENTION

The present invention relates generally to an electrophotographic printer, and more particularly, to a printer including a cooling apparatus to cool a fuser assembly within the printer and a system for controlling the cooling apparatus.

BACKGROUND OF THE INVENTION

In an electrophotographic (EP) imaging process used in printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image, and thereafter the toner image is transferred to the media intended to receive the final permanent image. The toner image is fixed to the media by the application of heat and pressure in a fuser assembly. A fuser assembly may include a heated roll and a backup roll forming a fuser nip through which the media passes. A fuser assembly may also include a fuser belt and an opposing backup member, such as a backup roller.

Modern fusers may incorporate fusing technology having a low thermal mass, in order to provide fast first fuse times and low power usage. One such fuser includes a fuser belt heated by a ceramic heater and a backup roller. The low thermal mass of the fuser presents problems with fuser temperature control such as overshoot and droop, and makes overheating of the backup roller more likely.

SUMMARY OF THE INVENTION

In accordance with a first aspect of the present invention, a printer is provided. The printer may comprise a reference edge adapted to be contacted by a substrate as the substrate moves along a substrate path through the printer, a fuser assembly comprising a heat transfer member including a belt and a backup member, and a cooling apparatus adapted to move cooling air capable of cooling the fuser assembly. The printer may further comprise a controller coupled to the cooling apparatus to activate and the deactivate the cooling apparatus. The controller may be adapted to activate the cooling apparatus after determining that a first end portion of the backup member opposite a second end portion of the backup member near the reference edge is at a temperature above a predefined first threshold temperature.

In accordance with a second aspect of the present invention, a printer comprising a fuser assembly, a cooling apparatus, a temperature sensor and a controller is provided. The fuser assembly may comprise a heat transfer member including a belt and a backup member. The cooling apparatus may be adapted to move cooling air across the fuser assembly. The temperature sensor may be associated with a first portion of the backup member for sensing the temperature of the backup member. The controller may be coupled to the cooling apparatus and the temperature sensor and may activate the cooling apparatus after the temperature sensor senses that the backup member first portion is at a temperature above a predefined first threshold temperature.

BRIEF DESCRIPTION OF THE DRAWINGS

The following detailed description of the preferred embodiments of the present invention can best be understood when read in conjunction with the following drawings, where like structure is indicated with like reference numerals, and in which.

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
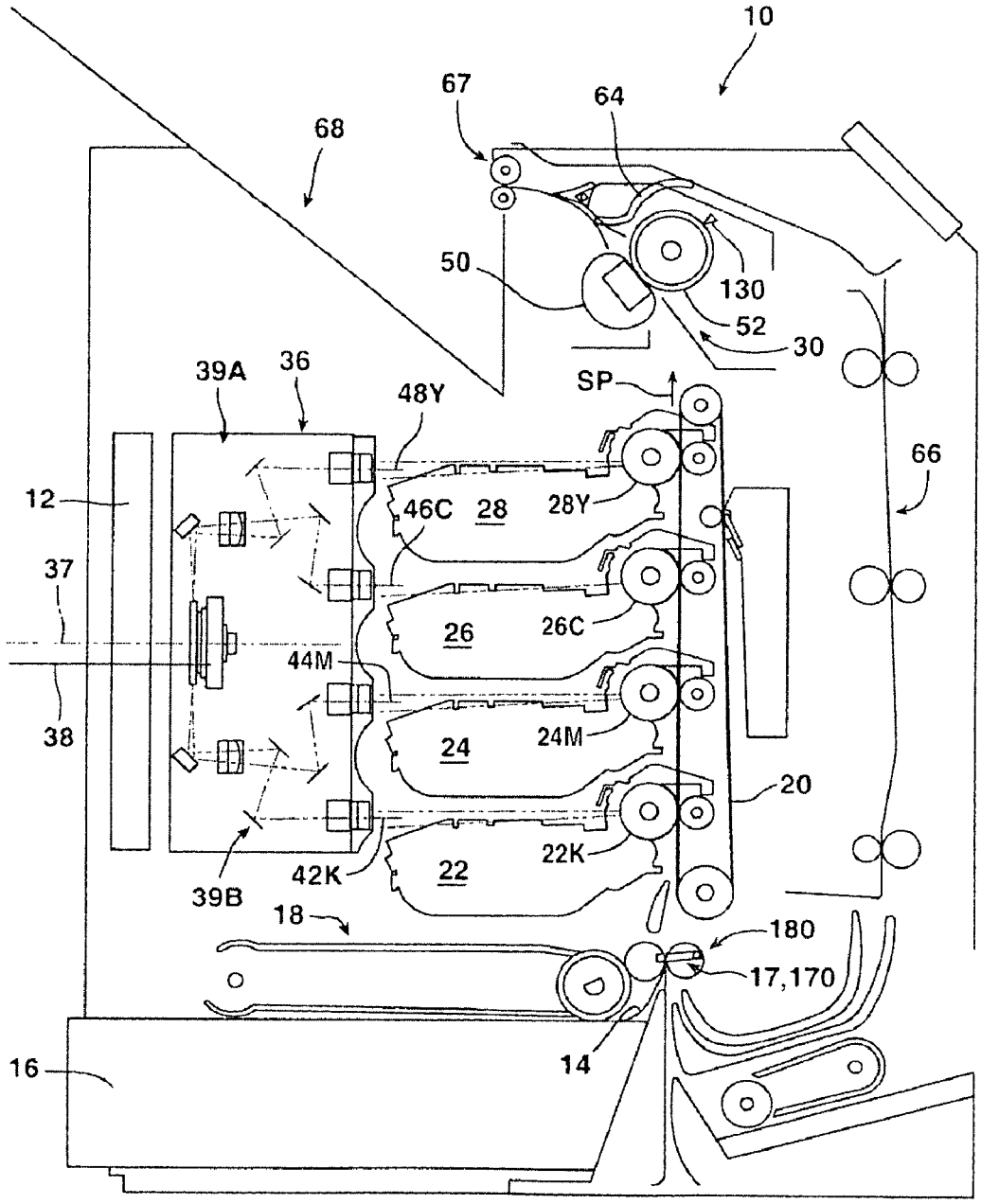
FIG. 1 is a diagrammatic illustration of an electrophotographic printer including a fuser assembly in accordance with an embodiment of the present invention.

FIG. 1 depicts an electrophotographic image forming apparatus comprising a color laser printer, which is indicated generally by the numeral 10. An image to be printed is electronically transmitted to a print engine processor or controller 12 by an external device (not shown) or may comprise an image stored in a memory of the controller 12. The controller 12 includes system memory, one or more processors, and other logic necessary to control the functions of electrophotographic imaging.

In performing a print operation, the controller 12 initiates an imaging operation where a top substrate 14 of a stack of media is picked up from a media tray 16 by a pick mechanism 18 and is delivered to a substrate transport apparatus comprising a pair of aligning rollers 180 and a substrate transport belt 20 in the illustrated embodiment. The substrate transport belt 20 carries the substrate 14 past each of four image forming stations 22, 24, 26, 28, which apply toner to the substrate 14. The image forming station 22 includes a photoconductive drum 22K that delivers black toner to the substrate 14 in a pattern corresponding to a black (K) image plane of the image being printed. The image forming station 24 includes a photoconductive drum 24M that delivers magenta toner to the substrate 14 in a pattern corresponding to the magenta (M) image plane of the image being printed. The image forming station 26 includes a photoconductive drum 26C that delivers cyan toner to the substrate 14 in a pattern corresponding to the cyan (C) image plane of the image being printed. The image forming station 28 includes a photoconductive drum 28Y that delivers yellow toner to the substrate 14 in a pattern corresponding to the yellow (Y) image plane of the image being printed. The controller 12 regulates the speed of the substrate transport belt 20, substrate timing, and the timing of the image forming stations 22, 24, 26, 28 to effect proper registration and alignment of the different image planes to the substrate 14.

To effect the imaging operation, the controller 12 manipulates and converts data defining each of the KMCY image planes into separate corresponding laser pulse video signals, and the video signals are then communicated to a printhead 36. The printhead 36 may include four laser light sources (not shown) and a single polygonal mirror 38 supported for rotation about a rotational axis 37, and post-scan optical systems 39A, 39B receiving the light beams emitted from the laser light sources. Each laser of the laser light sources emits a respective laser beam 42K, 44M, 46C, 48Y, each of which is reflected off the rotating polygonal mirror 38 and is directed towards a corresponding one of the photoconductive drums 22K, 24M, 26C, 28Y by select lenses and mirrors in the post-scan optical systems 39A, 39B.

The substrate transport belt 20 then carries the substrate 14 with the unfused toner image planes superposed thereon further along the substrate path SP to a fuser assembly 30. The fuser assembly 30 may comprise a heat transfer member 50 and a backup member comprising a backup roller 52 in the illustrated embodiment defining a pressure member cooperating with the heat transfer member 50 to define a fuser assembly nip 53 for conveying substrates 14 therebetween. The heat transfer member 50 and the backup roller 52 may be constructed from the same elements and in the same manner as the heat transfer member and pressure roller 52 disclosed in U.S. Pat. No. 7,235,761, the entire disclosure of which is incorporated herein by reference. The fuser assembly 30 further comprises a temperature sensor 130 for sensing the temperature of a portion 52A of the backup roller 52, a thermistor in the illustrated embodiment, see FIGS. 1-4.

Figure 2:
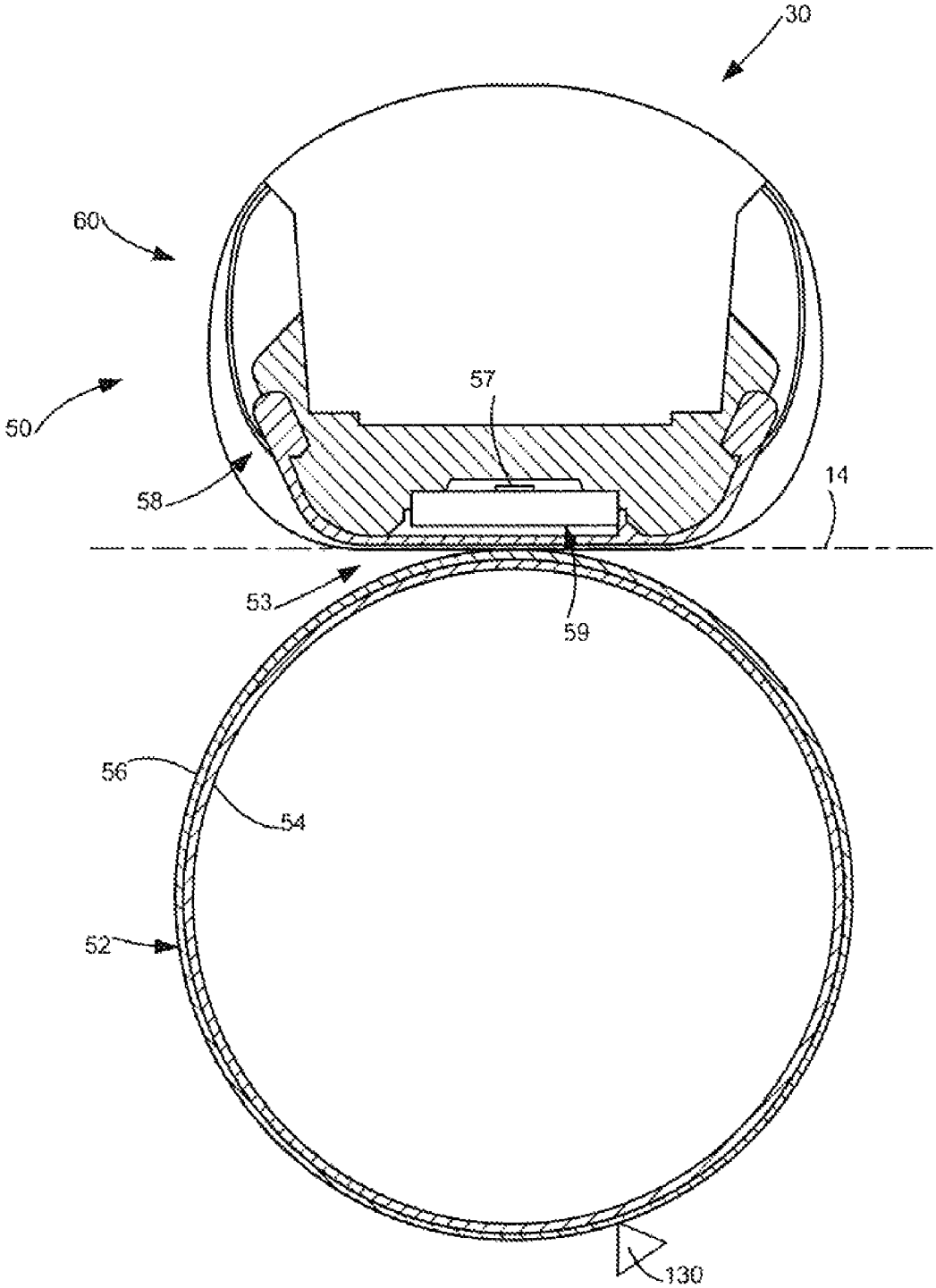
FIG. 2 is a side view, partially in cross section, of the fuser assembly illustrated in FIG. 1.

The heat transfer member 50 may comprise a housing 58, a heater 59 supported on the housing 58, and an endless flexible fuser belt 60 positioned about the housing 58, see FIG. 2. A heater temperature sensor 57, such as a thermistor, is coupled to a surface of the heater 59 opposite a heater surface in contact with the belt 60. The belt 60 may comprise a flexible thin film, and preferably comprises a stainless steel tube having a thickness of approximately 35-50 microns, an elastomeric layer, such as a silicone rubber layer, having a thickness of approximately 250-350 microns, covering the stainless steel tube and a release layer, such as a PFA (polyperfluoroalkoxy-tetrafluoroethylene) sleeve, having a thickness of approximately 25-40 microns, covering the elastomeric layer. The release layer is formed on the outer surface of the stainless steel tube so as to contact substrates 14 passing between the heat transfer member 50 and the backup roller 52.

The backup roller 52 may comprise a hollow core 54 covered with an elastomeric layer 56, such as silicone rubber, and a fluororesin outer layer (not shown), such as may be formed, for example, by a spray coated PFA (polyperfluoroalkoxy-tetrafluoroethylene) layer, PFA-PTFE (polytetrafluoroethylene) blended layer, or a PFA sleeve. The backup roller 52 has an outer diameter of about 30 mm. The backup roller 52 may be driven by a fuser drive train (not shown) to convey substrates 14 through the fuser assembly 30.

An exit sensor 64, see FIG. 1, is provided downstream from the fuser assembly 30 for sensing and generating signals corresponding to the passage of successive substrates 14 through the fuser assembly 30.

After leaving the fuser assembly 30, a substrate 14 may be fed via exit rollers 67 into a duplexing path 66 for a duplex print operation on a second surface of the substrate 14, or the substrate 14 may be conveyed by the exit rollers 67 into an output tray 68.

Figure 4:
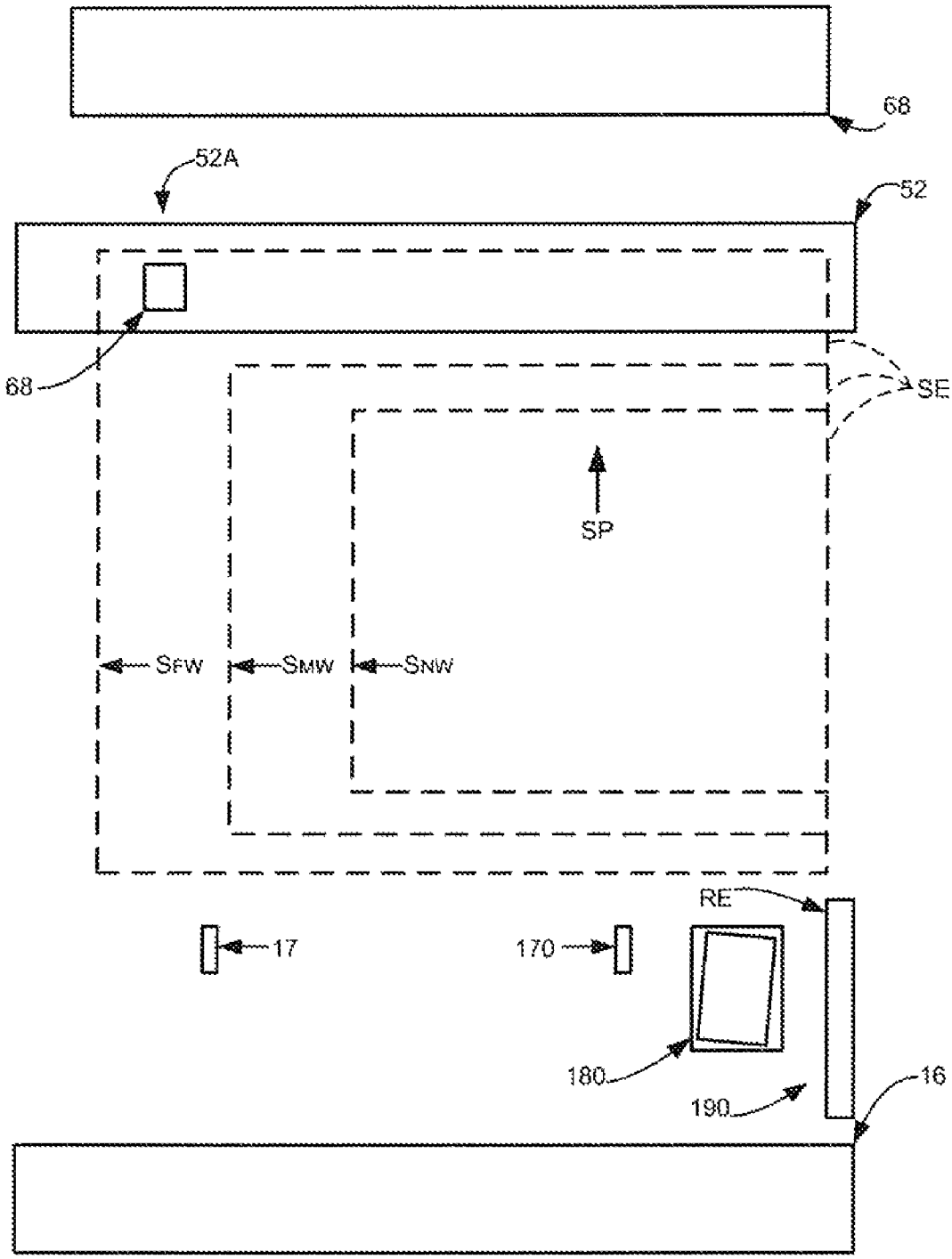
FIG. 4 is a schematic view of a substrate path SP including a printer reference edge RE.

The printer 10 further comprises a guide structure 190 defining a reference edge RE along an outer edge of a portion of the substrate path SP, see FIG. 4. A side edge SE of each substrate 14 engages and moves along the reference edge RE as it travels from the media tray 16 through the aligning rollers 180 to the substrate transport belt 20. Each substrate 14 stays aligned with the reference edge RE after it leaves the reference edge RE and travels further along the substrate path SP past the image forming stations 22, 24, 26 and 28, through the fuser assembly 30 and into the output tray 68, see FIG. 4, which is a schematic illustration of the substrate path SP including the reference edge RE.

In FIG. 4, three different substrates $S_{FW}$, $S_{MW}$ and $S_{NW}$ having three separate widths are shown in dotted line. Substrate $S_{FW}$ comprises a full width substrate and, in the illustrated embodiment, is an A4 substrate having a width of 210 mm. A full width substrate $S_{FW}$ may comprise any substrate having a width greater than about 205 mm. Substrate $S_{MW}$ comprises a mid-width substrate and, in the illustrated embodiment, is a B5 substrate having a width of 176 mm. A mid-width substrate may comprise any substrate having a width between about 173 mm and about 195 mm. Substrate $S_{NW}$ comprises a narrow width substrate and, in the illustrated embodiment, is an A5 substrate having a width of 148 mm. A narrow width substrate may have a width less than about 163 mm.

A first media sensor 17, comprising an optical interrupter and flag sensor, may be provided downstream from the pick mechanism 18 and prior to the first image forming station 22, see FIG. 1. In the illustrated embodiment, the media sensor 17 is spaced approximately 168 mm away from the reference edge RE, see FIG. 4, in a direction transverse to the direction of the substrate path SP. Hence, the first media sensor 17 is actuated by full width substrates $S_{FW}$ and mid-width substrates $S_{MW}$ as each such substrate $S_{FW}$, $S_{MW}$ moves along the substrate path SP and passes beneath the first media sensor 17. The first media sensor 17 is not actuated by narrow width substrates $S_N$ as those substrates do not pass beneath the media sensor 17 as they travel along the substrate path SP.

A second media sensor 170 may also be provided downstream from the pick mechanism 18 and prior to the first image forming station 22, see FIG. 4. In the illustrated embodiment, the second media sensor 170 is spaced approximately 40 mm away from the reference edge RE, see FIG. 4, in a direction transverse to the direction of the substrate path SP. Hence, the second media sensor 170 is actuated by full width substrates $S_{FW}$, mid-width substrates $S_{MW}$ and narrow width substrates $S_{NW}$ as each such substrate moves along the substrate path SP and passes beneath the second media sensor 170.

As noted above, the temperature sensor 130 senses the temperature of the backup roller portion 52A, see FIG. 4, wherein the backup roller portion 52A is also referred to herein as a first end portion 76 of the backup roller 52. In the illustrated embodiment, the temperature sensor 130 is spaced approximately 200 mm from the reference edge RE, see FIG. 4, in a direction transverse to the direction of the substrate path SP so as to be positioned near a first end 74 of the backup roller 52. The backup roller first end 74 is opposite to a backup roller second end 80, which is near the reference edge RE. The backup roller portion 52A comprises a circumferential portion of the backup roller 52, which is also spaced approximately 200 mm from the reference edge RE, see FIGS. 3 and 4. Hence, the backup roller portion 52A engages full width substrates $S_{FW}$ as each full width substrate $S_{FW}$ moves through the fuser assembly nip 53. However, the backup roller portion 52A does not engage mid-width substrates $S_{MW}$ or narrow width substrates $S_{NW}$ as those substrates do not extend in a widthwise direction from the reference edge RE to the backup roller portion 52A.

Figure 3:
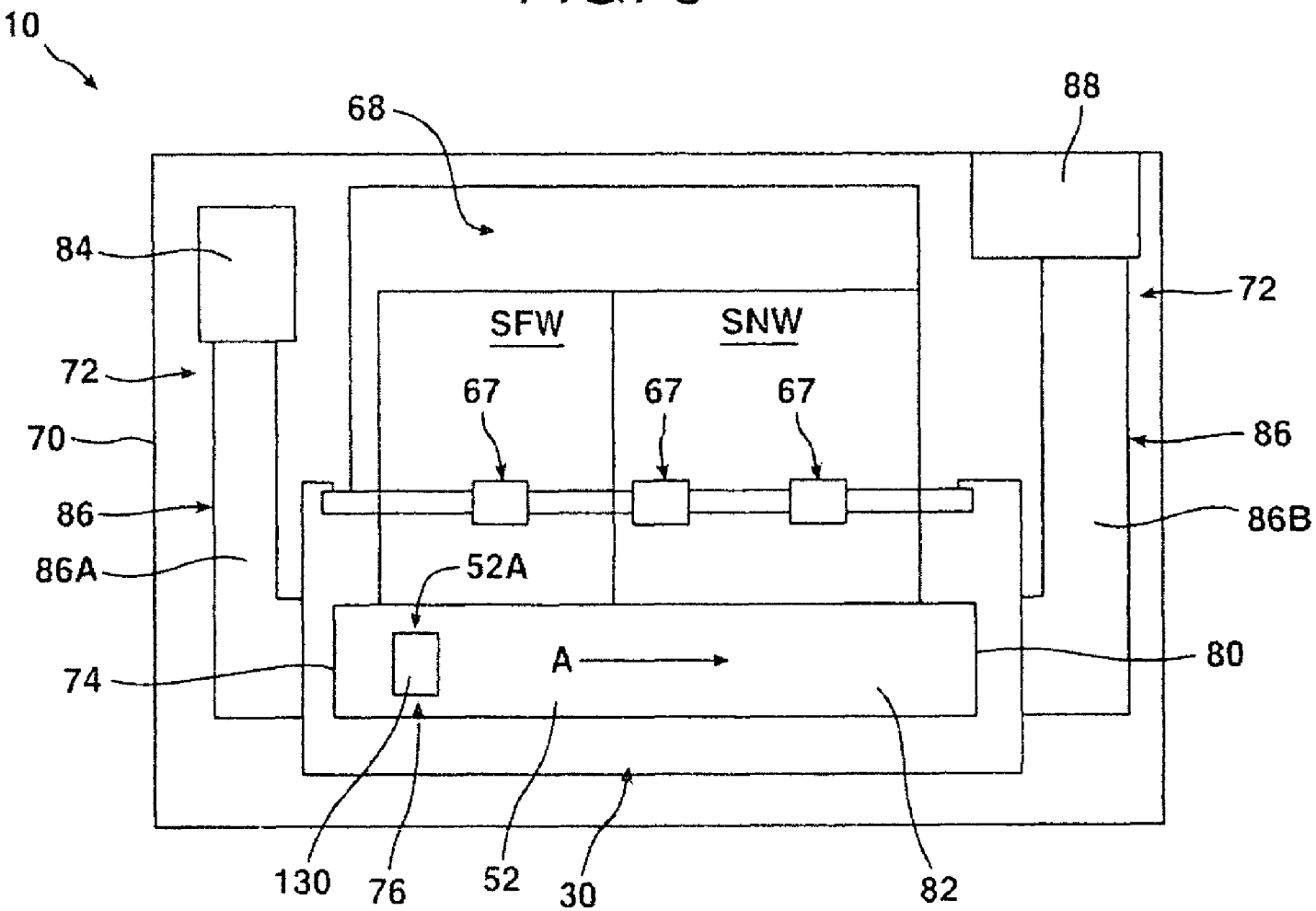
FIG. 3 is a diagrammatic illustration of the printer illustrated in FIG. 1 taken in top view.

As illustrated in FIG. 3, a narrow width substrate $S_{NW}$ is in contact with a second end portion 82 of the backup roller 52 proximate to the second end 80 as the narrow width substrate $S_{NW}$ moves along the substrate path SP and through the fuser assembly 30 but is not in contact with the first end portion 76 of the backup roller 52. Conversely, a full width substrate $S_{FW}$ is in contact with both the second end portion 82 and the first end portion 76 of the backup roller 52 as it moves along the substrate path SP and through the fuser assembly 30.

The controller 12 is coupled to the first and second media sensors 17 and 170 and the temperature sensor 130 for receiving corresponding signals generated by the media sensors 17 and 170 and the temperature sensor 130.

The fuser assembly 30 is cooled by passing cooling air through and across the fuser assembly 30. A cooling apparatus 72 is provided to force the cooling air across the fuser assembly 30, as will be discussed more thoroughly below. The cooling apparatus 72 may operate at two or more different speeds in the illustrated embodiment. As the speed of the cooling apparatus 72 is increased, more cooling air is passed through and across the fuser assembly 30 and a greater amount of heat energy is removed from the fuser assembly 30.

As a substrate 14 passes through the fuser assembly 30, heat is transferred from the fuser belt 60 to the substrate 14 to fuse a toner image onto a surface of the substrate 14. During fusing operations, a portion of the heat transferred from the fuser belt 60 to a substrate 14 passes through the substrate 14 to the backup roller 52 causing the temperature of the backup roller 52 to increase. Further, heat is transferred directly from the fuser belt 60 to the backup roller 52 at portions of the backup roller 52 not contacting substrate material. Heat is also transferred from the fuser belt 60 directly to the backup member 51 during each interpage gap when no substrate 14 is present between the fuser belt 60 and the backup roller 52. If a temperature of all or a portion of the backup roller 52 is excessive, the overheated portion(s) may be degraded.

The controller 12 may vary or change a heater target temperature, a substrate pick time, a substrate pick rate and/or a substrate path process speed based on substrate size and the backup member temperature as sensed by the temperature sensor 130 as discussed in U.S. patent application Ser. No. 12/055,614, entitled FUSER HEATER TEMPERATURE CONTROL; U.S. patent application Ser. No. 12/055,399, entitled PRINTER INCLUDING A FUSER ASSEMBLY WITH BACKUP MEMBER TEMPERATURE SENSOR; and U.S. patent application Ser. No. 12/055,561, entitled FUSER ASSEMBLY HEATER TEMPERATURE CONTROL, all of which have previously been incorporated by reference herein.

In the illustrated embodiment, when fusing narrow width substrates $S_{NW}$ and mid-width substrates $S_{MW}$, the fuser belt 60 is in direct contact with the first end portion 76 of the backup roller 52 at all times while the fuser belt 60 is generally in contact with the second end portion 82 of the backup roller 52 only during interpage gaps. Much of the heat energy transferred from the fuser belt 60 to the substrates 14 is carried away from the fuser assembly 30 by the substrates 14 as the substrates 14 move through the fuser assembly 30 and into the duplex path 66 or the output tray 68. As a result, more heat energy is transferred to the backup roller first end portion 76 than is transferred to the backup roller second end portion 82 when fusing narrow width substrates $S_{NW}$ or mid-width substrates $S_{MW}$. This causes the temperature of the first end portion 76 to increase more rapidly than the temperature of the second end portion 82 when fusing narrow width substrates $S_{NW}$ or mid-width substrates $S_{MW}$. Further, the temperature of the backup roller first end portion 76 may exceed a maximum operating temperature unless the excess heat energy is removed from the first end portion 76 when fusing narrow width substrates $S_{NW}$ or mid-width substrates $S_{MW}$.

As previously mentioned, the cooling apparatus 72 is provided to force cooling air across and through the fuser assembly 30 to remove heat energy therefrom. The cooling apparatus 72 comprises, in the illustrated embodiment, a first fan device 84, a second fan device 88 and duct structure 86. The first fan device 84 is configured to draw cooling air into the printer 10 from outside of a printer cover structure 70 and to force the cooling air into and along the duct structure 72. The duct structure 86 comprises a first duct structure section 86A configured to define a path for the cooling air to move from the first fan device 84 to the fuser assembly 30 near the first end 76 of the backup roller 52 such that the cooling air flows across and through the fuser assembly 30 in the direction indicated by the arrow A from the first end 76 of the backup roller 52 and toward the second end 82 of the backup roller 52, see FIG. 3.

The second fan device 88 is provided to draw or pull cooling air away from the fuser assembly 30 after the cooling air has passed across and through the fuser assembly 30 and to expel the cooling air to the ambient atmosphere outside of the cover structure 70. A second duct structure section 86B is provided between the fuser assembly 30 near the second end 82 of the backup roller 52 and the second fan device 88. The second duct structure section 86B is configured to define a path for the cooling air to travel from the fuser assembly 30 to the second fan device 88 so as to allow the second fan device 88 to draw cooling air that has been forced across and through the fuser assembly 30 by the first fan device 84 away from the fuser assembly 30. In this manner, the cooling air is forced across and through the fuser assembly 30 in the direction of the arrow A from the first end of the backup roller 52, across the first end portion 76 of the backup roller 52 prior to passing across the second end portion 82 of the backup roller 52. Hence, the backup roller first end portion 76 is cooled by the cooling air before the temperature of the cooling air is raised substantially as heat is removed from the portions of the components of the fuser assembly 30 and transferred to the cooling air.

Though the cooling apparatus 72 illustrated in FIG. 3 comprises first and second fan devices 84 and 88 and first and second duct structure sections 86A and 86B, it is anticipated that other embodiments of the present invention may comprise a cooling apparatus comprising one, two or more fan devices with or without associated duct structure. It is further anticipated that other embodiments of the present invention may pass cooling air across and the fuser assembly 30 in directions other than the direction indicated by the arrow A.

The controller 12 is coupled to the first and second fan devices 84 and 88 and controls the first and second fan devices 84 and 88 as will be described more thoroughly below. In the illustrated embodiment, the controller 12 controls the operation of the first and second fan devices 84 and 88 independent of its control of the heater 59.

As previously mentioned, the temperature sensor 130 is positioned proximate to the first end 74 of the backup roller 52 and is configured to measure the temperature of the first end portion 76 of the backup roller 52. The controller 12 is configured to activate the cooling apparatus 72 after determining that the temperature of the first end portion 76 of the backup member 51 is at a temperature above a predefined first threshold temperature. For example, the controller 12 may cause the first and second fan devices 84 and 88 to operate at a first speed when the controller 12 determines that the temperature of the first end portion 76 of the backup roller 52 has risen to a temperature equal to approximately 120 degrees C. or higher. Removing excess heat from the first end portion 76 of the backup roller 52 prevents the first end portion 76 of the backup roller 52 from overheating and allows the controller 12 to maximize the throughput of the printer 10 without reducing the transport speed and/or increasing the interpage gap as might otherwise be required.

The controller 12 is further configured to operate the cooling apparatus 72 at a second speed that is greater than the first speed when the controller 12 determines that the temperature of the first end portion 76 of the backup roller 52 is at a temperature above a predefined second threshold temperature. For example, the controller 12 may cause the first and second fan devices 84 and 88 to operate at the second speed when the controller determines that the temperature of the first end portion 76 of the backup roller 52 has risen to a temperature equal to approximately 160 degrees C. or higher. Operation of the first and second fan devices 84 and 88 at the second speed provides increased cooling air flow through and across the fuser assembly 30 such that the controller 12 may optimize the throughput of the printer 10 without damage to components of the fuser assembly 30 due to overheating.

The temperature of the first end portion of the backup roller 52 may rise to a temperature high enough to cause damage to the backup roller 52 or other fuser components in certain abnormal conditions. For example, fusing multiple substrates having very narrow widths with small interpage gaps may cause sufficient heat energy to be transferred from the fuser belt 60 to the first end portion 76 of the backup roller 52 such that the temperature of the first end portion 76 becomes excessive resulting in damage to the backup member 51 or other fuser components.

The controller 12 is configured to turn off the power to the heater 59 and shut down the printer if the temperature of the first end portion 76 of the backup roller 52 exceeds a third predefined threshold temperature, for example, 220 degrees C.

In another embodiment of the present invention, the controller 12 may be configured to determine that the temperature of the first end portion of the backup roller 52 is at a temperature greater than the first, second or third predefined threshold temperatures without monitoring signals from a backup roller temperature sensor 130. Hence, a backup roller temperature sensor 130 may not be provided in this embodiment. For example, the controller 12 may be configured to determine that the temperature of the first end portion of the backup roller 52 is at a temperature greater than the first predefined threshold temperature after a predetermined first number of narrow width substrates $S_{NW}$ or mid-width substrates $S_{MW}$ have been successively printed. In like manner, the controller 12 may be configured to determine that the temperature of the first end portion of the backup roller 52 is at a temperature greater than the second predefined threshold temperature after a predetermined second number, greater than the predetermined first number, of narrow width substrates $S_{NW}$ or mid-width substrates $S_{MW}$ have been successively printed. Further, the controller 12 may be configured to determine that the temperature of the first end portion of the backup roller 52 is at a temperature greater than the third predefined threshold temperature after a predetermined third number, greater than the predetermined second number, of narrow width substrates $S_{NW}$ or mid-width substrates $S_{MW}$ have been successively printed.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A printer comprising:

a reference edge adapted to be contacted by a substrate as the substrate moves along a substrate path through the printer;

a fuser assembly comprising a heat transfer member including a belt and a backup member;

cooling apparatus adapted to move cooling air capable of cooling said fuser assembly; and a controller coupled to said cooling apparatus to activate and deactivate said cooling apparatus, said controller activating said cooling apparatus after determining that a first end portion of said backup member opposite a second end portion of said backup member near said reference edge is at a temperature above a predefined first threshold temperature;

wherein said cooling apparatus comprises a fan apparatus coupled to said controller, and said controller reaches a determination that said first end portion of said backup member is at a temperature above the predefined first threshold temperature after a predetermined first number of narrow substrates have been successively printed and, in response, activates said fan apparatus at a first speed.

2. The printer as set out in claim 1, wherein said heat transfer member comprises:

a heater assembly comprising a housing and a heater element mounted in said housing; and said belt comprising a flexible belt positioned about said heater assembly and including an inner surface engageable with said heater element so as to receive energy in the form of heat generated by said heater element.

3. The printer as set out in claim 2, wherein said backup member comprises a driven backup member positioned in opposition to said heater assembly, said flexible belt extending between said heater assembly and said driven backup member such that a fusing nip for receiving a substrate is defined between said backup member and said flexible belt.

4. The printer as set out in claim 1, wherein said fan apparatus comprises a fan device for pulling air through said a duct structure in a direction toward said reference edge.

5. The printer as set out in claim 1, wherein said controller reaches a determination that said first end portion of said backup member is at a temperature above a predefined second threshold temperature, greater than said predefined first threshold temperature, after a predetermined second number of narrow substrates have been successively printed and, in response, activates said fan apparatus at a second speed greater than said first speed.

6. The printer as set out in claim 1, further comprising a temperature sensor associated with said first end portion of said backup member and generating temperature signals to said controller corresponding to the temperature of said backup member first end portion, and wherein said controller reaches a determination that said first end portion of said backup member is at a temperature above the predefined first threshold temperature in response to said temperature sensor sensing that said first end portion of said backup member is at a temperature above the predefined first threshold temperature and, in response, activating said fan apparatus at a first speed.

7. The printer as set out in claim 6, wherein said controller reaches a determination that said first end portion of said backup member is at a temperature above a predefined second threshold temperature, greater than said predefined first threshold temperature, in response to said temperature sensor sensing that said first end portion of said backup member is at a temperature above the predefined second threshold temperature and, in response, activating said fan apparatus at a second speed greater than said first speed.

8. The printer as set out in claim 6, wherein said temperature sensor comprises a thermistor in contact with said backup member first end portion.

9. A printer comprising:

a fuser assembly comprising a heat transfer member including a belt and a backup member;

cooling apparatus adapted to move cooling air across said fuser assembly, wherein said cooling apparatus comprises a fan apparatus;

a temperature sensor associated with a first portion of said backup member for sensing the temperature of said backup member; and a controller coupled to said cooling apparatus and said temperature sensor, said controller activating said cooling apparatus after said temperature sensor senses that said backup member first portion is at a temperature above a predefined first threshold temperature;

wherein said controller reaches a determination that said first end portion of said backup member is at a temperature above the predefined first threshold temperature in response to said temperature sensor sensing that said first end portion of said backup member is at a temperature above the predefined first threshold temperature and, in response, activates said fan apparatus at a first speed, and wherein said controller reaches a determination that said first end portion of said backup member is at a temperature above a predefined second threshold temperature, greater than said predefined first threshold temperature, in response to said temperature sensor sensing that said first end portion of said backup member is at a temperature above the predefined second threshold temperature and, in response, activates said fan apparatus at a second speed greater than said first speed.

10. The printer as set out in claim 9, wherein said heat transfer member comprises:

a heater assembly comprising a housing and a heater element mounted in said housing; and said belt comprising a flexible belt positioned about said heater assembly and including an inner surface engageable with said heater element so as to receive energy in the form of heat generated by said heater element.

11. The printer as set out in claim 10, wherein said backup member comprises a driven backup member positioned in opposition to said heater assembly, said flexible belt extending between said heater assembly and said driven backup member such that a fusing nip for receiving a substrate is defined between said backup member and said flexible belt.

12. The printer as set out in claim 9, wherein said fan apparatus comprises a fan device for pulling air through a duct structure.

13. The printer as set out in claim 12, wherein said fan apparatus comprises a further fan device for forcing air into and along said duct structure to move air in a direction across said fuser assembly.

14. The printer as set out in claim 9, wherein said temperature sensor comprises a thermistor in contact with said backup member first end portion.

* * * * *